US008955199B2

(12) United States Patent
Chang

(10) Patent No.: US 8,955,199 B2
(45) Date of Patent: Feb. 17, 2015

(54) SHOELACE FASTENER

(71) Applicant: TZY Shenq Enterprise Co., Ltd., Taichung (TW)

(72) Inventor: Li-Chen Chang, Taichung (TW)

(73) Assignee: TZY Shenq Enterprise Co., Ltd., Taichung (TW)

( * ) Notice: Subject to any disclaimer, the term of this patent is extended or adjusted under 35 U.S.C. 154(b) by 148 days.

(21) Appl. No.: 13/765,854

(22) Filed: Feb. 13, 2013

(65) Prior Publication Data

US 2014/0223704 A1 Aug. 14, 2014

(51) Int. Cl.
*A43C 11/16* (2006.01)

(52) U.S. Cl.
CPC ..... *A43C 11/165* (2013.01)
USPC ..... 24/68 SK

(58) Field of Classification Search
CPC ..... A43C 11/165
USPC ..... 24/68 SK
See application file for complete search history.

(56) References Cited

U.S. PATENT DOCUMENTS 4,633,599 A * 1/1987 Morell et al. ..... 242/388.1
4,748,726 A * 6/1988 Schoch ..... 24/68 SK
7,331,126 B2 * 2/2008 Johnson ..... 36/50.1
7,900,670 B2 * 3/2011 McCauley et al. ..... 152/219
7,950,112 B2 * 5/2011 Hammerslag et al. ..... 24/68 SK
7,954,204 B2 * 6/2011 Hammerslag et al. ..... 24/68 SK
7,992,261 B2 * 8/2011 Hammerslag et al. ..... 24/68 SK
8,091,182 B2 * 1/2012 Hammerslag et al. ..... 24/68 SK
8,308,098 B2 * 11/2012 Chen ..... 242/378.1
8,468,657 B2 * 6/2013 Soderberg et al. ..... 24/68 SK
2003/0093882 A1 * 5/2003 Gorza et al. ..... 24/68 SK
2008/0060167 A1 * 3/2008 Hammerslag et al. ..... 24/68 SK
2012/0167281 A1 * 7/2012 Gennrich et al. ..... 2/410

* cited by examiner

*Primary Examiner* — Robert J Sandy
*Assistant Examiner* — Louis Mercado
(74) *Attorney, Agent, or Firm* — Muncy, Geissler, Olds & Lowe, P.C.

(57) ABSTRACT

A shoelace fastener includes a main body, a reel, a first elastic member, a rotating member and a spindle. When an operation member of the rotating member is located in a first position, a clutch member engages with the spindle. The rotating member drives the spindle to rotate and the spindle drives the reel to rotate along a first direction. When the operation member is located in a second position, the clutch member is away from the spindle. The first elastic member drives the reel to rotate and the reel drives the spindle to rotate along a second direction. Thereby, the tension of a wire is easy to be controlled. The reel doesn't turn in reverse randomly. As the operation member is raised up, it reminds a user that the reel is not adjusted to rotate unidirectionally yet.

10 Claims, 7 Drawing Sheets

SHOELACE FASTENER

BACKGROUND OF THE INVENTION

1. Field of the Invention

The invention relates to a shoelace fastener for a shoe, more particularly to a shoelace fastener for adjusting a tightened state of the shoe.

2. Description of the Prior Art

Generally speaking, a normal shoelace is fastened manually. However, the shoelace is easy to be released with this kind of fastening means. Especially for an athlete, if the shoelace releases, it will affect expression of the athlete.

There is a conventional shoelace fastener comprising a reel, a rotating member, a ratchet and a pawl. A shoelace winds on the reel. The rotating member rotatably fastens the shoelace tightly or releases it. The combination of the ratchet and the pawl prevents the reel turning in reverse and the shoelace would not be released. If a user would like to release the shoelace, he has to pull up the rotating member by one hand so that a gear wheel of the rotating member is away from a gear wheel of the reel and hold two ends of the shoelace by the other hand to pull out the shoelace from the shoelace fastener. However, the operation of releasing the shoelace is difficult. It is not easy to control the tension of the shoelace. If the shoelace is too loose, the user has to pull it tightly again.

Moreover, when the user fastens the shoelace well, he often forgets to push the rotating member back to the original position. The shoelace would be released as the user is running and he will stumble.

Furthermore, the structure of the shoelace fastener is so complex that it is difficult to install and the manufacturing cost of the shoelace fastener is high.

The present invention is, therefore, arisen to obviate or at least mitigate the above mentioned disadvantages.

SUMMARY OF THE INVENTION

The main object of the present invention is to provide a shoelace fastener whose structure is simple. The operation of the shoelace fastener is easy. The safety of the shoelace is outstanding.

To achieve the above and other objects, a shoelace fastener of the present invention comprises a main body, a reel, a first elastic member, a rotating member and a spindle.

The reel is rotatably disposed in the main body. The reel is used for a wire winding thereon. Two ends of the wire penetrate the main body respectively.

The first elastic member comprises two ends. One end of the first elastic member fixed on the main body, and the other end of the first elastic member fixed on the reel.

The rotating member comprises a base body, a clutch member and an operation member. One of the base body and the main body has a pawl portion, and the other one of the base body and the main body has a ratchet portion. The pawl portion engages with the ratchet portion. The clutch member is disposed between the base body and the operation member. The operation member moves between a first position and a second position with respect to the base body.

The spindle penetrates the rotating member. The spindle comprises a first end and a second end.

Wherein when the operation member is located in the first position, the clutch member engages with the first end of the spindle. The rotating member drives the spindle to rotate and the spindle drives the reel to rotate along a first direction and the first elastic member is rolled up tightly. When the operation member is located in the second position, the clutch member is away from the first end of the spindle. The elasticity of the first elastic member drives the reel to rotate along a second direction which is the opposite of the first direction. The reel drives the spindle to rotate along the second direction.

Thereby, the operation member is able to move with respect to the base body so that the clutch member is away from or engages with the first end of the spindle. As a result, the tension of the wire is easy to be controlled. The operation means is simple. The structure of the shoelace fastener is simple so that the shoelace fastener is easy to install. Besides, the reel does not turn in reverse randomly. Note that as the operation member is located in the first position, the operation member is raised up for reminding the user that the reel is not adjusted to rotate unidirectionally yet.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
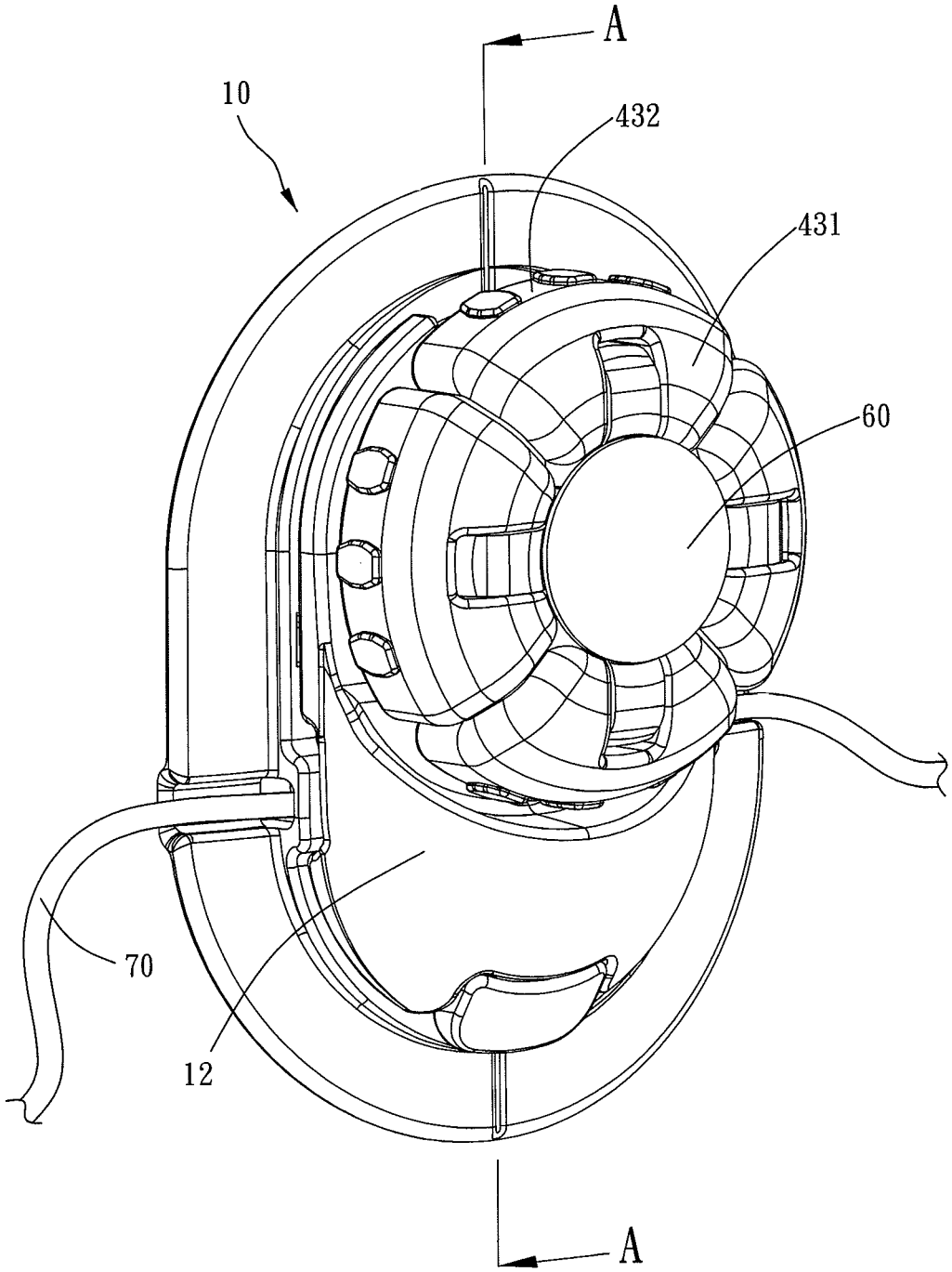
FIG. 1 is a stereogram of the present invention.
Figure 2:
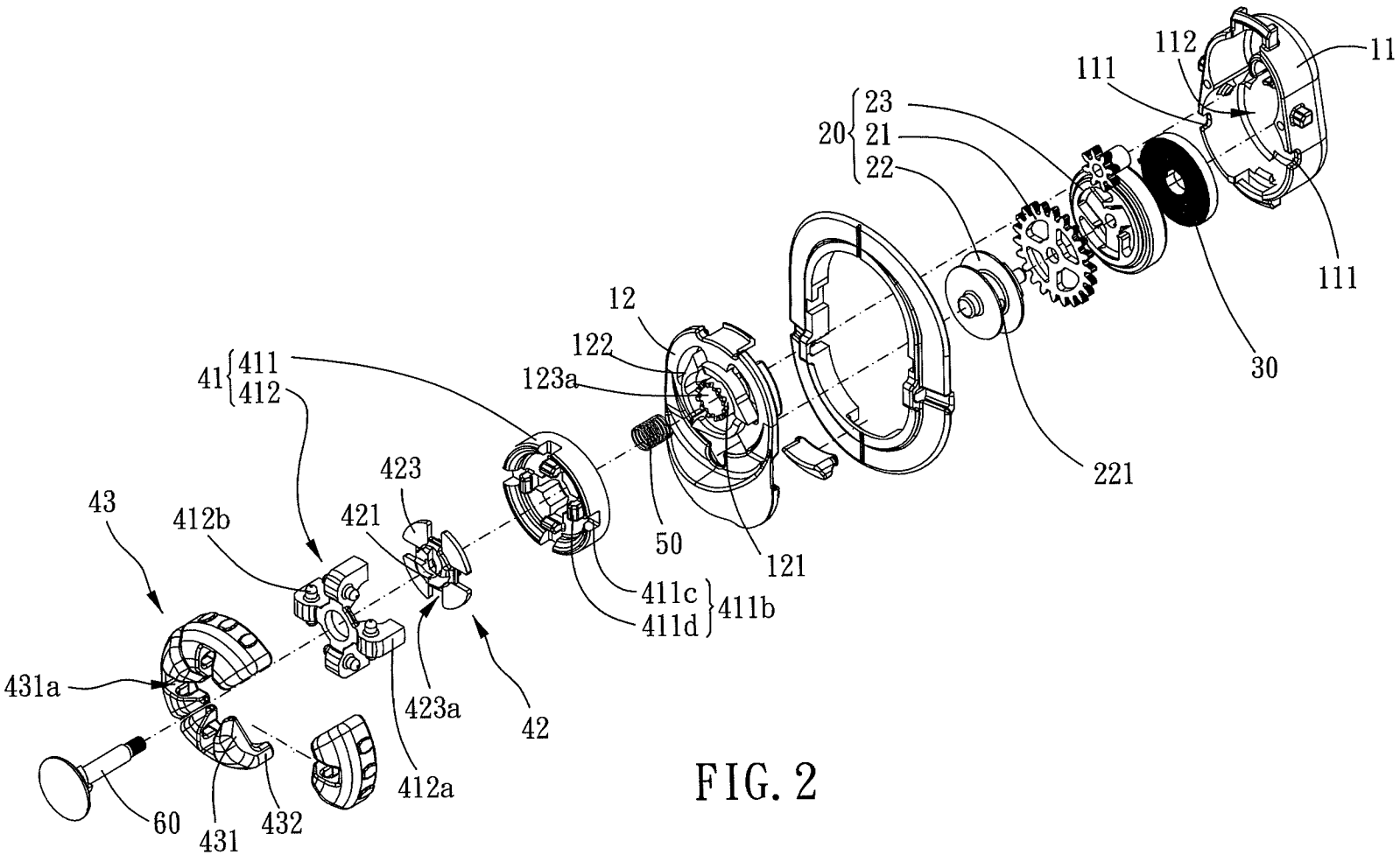
FIG. 2 is a breakdown drawing of the present invention.
Figure 3:
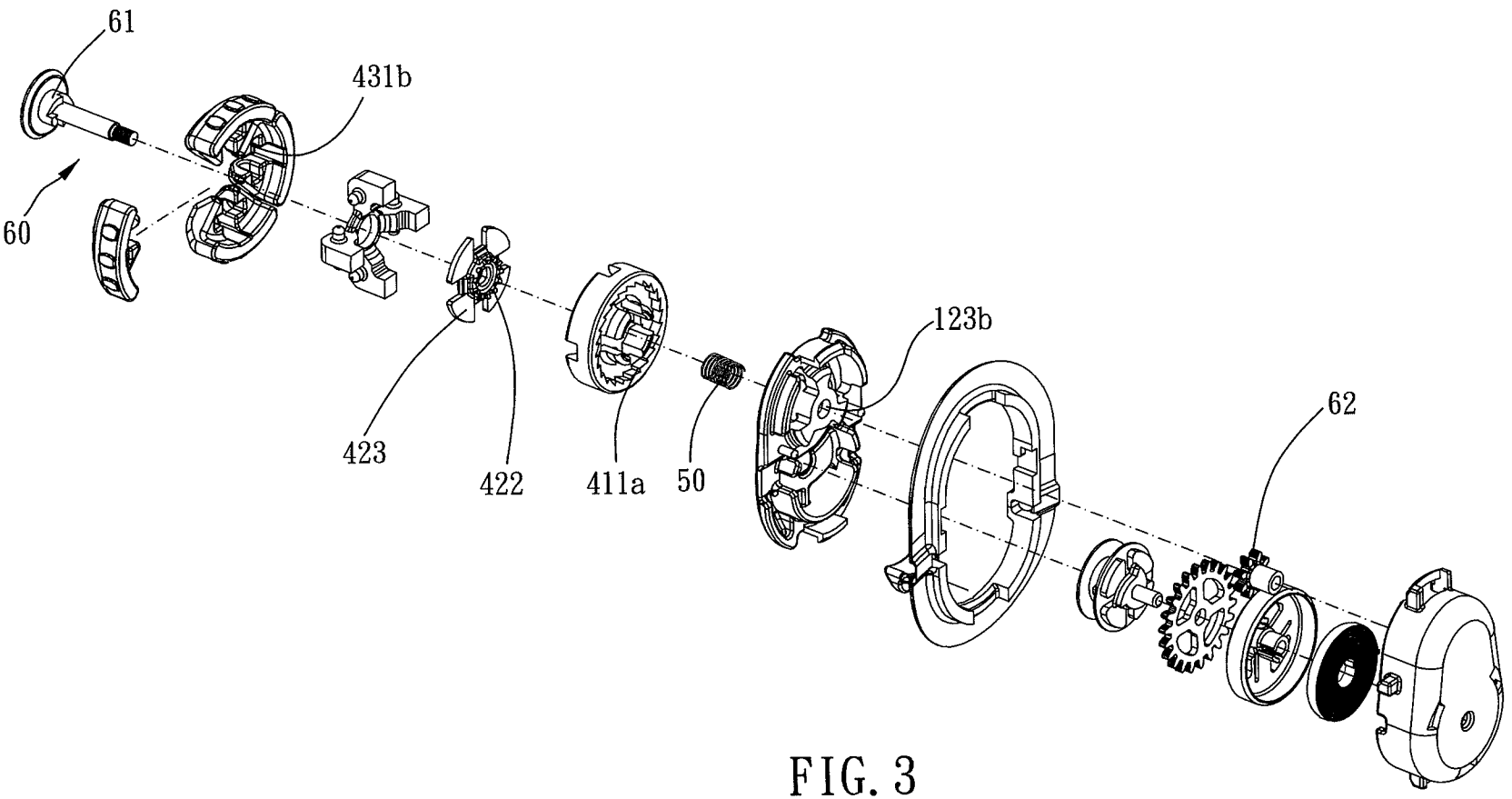
FIG. 3 is a breakdown drawing of the present invention.

Please refer to FIG. 1 to FIG. 3. A shoelace fastener comprises a main body 10, a reel 20, a first elastic member 30, a rotating member, a second elastic member 50 and a spindle 60.

The main body 10 comprises a base 11 and a housing 12. The housing 12 is detachably disposed on the base 11. The base 11 is formed with two through holes 111 and defines a receiving space 112. The through holes 111 are in communication with the receiving space 112. One side of the housing 12 away from the base 11 has a first engaging portion 121 and a pawl portion 122. The first engaging portion 121 has a plurality of first teeth.

Figure 7:
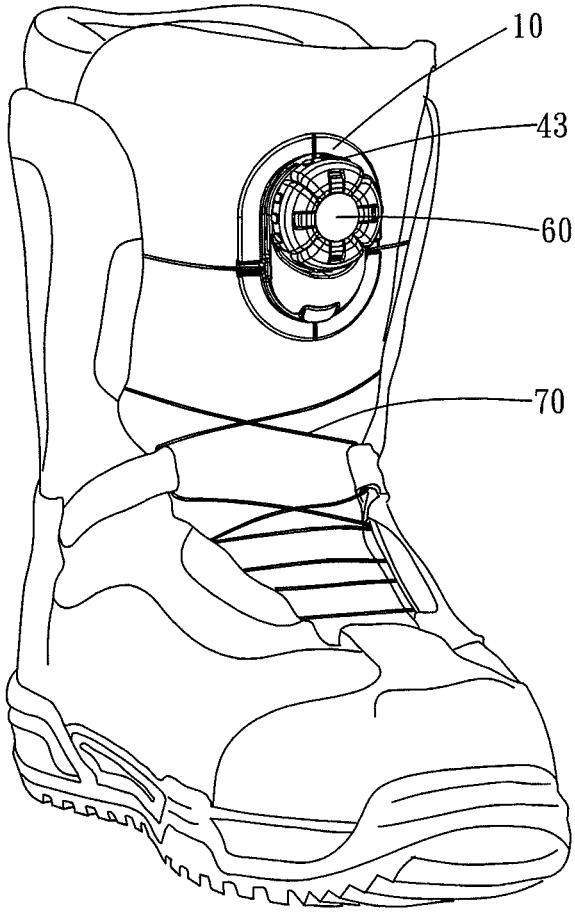
FIG. 7 is a schematic drawing showing a shoelace fastener of the present invention installing on a ski boot.

The reel 20 is rotatably disposed in the receiving space 112. The reel is used for a wire 70 winding thereon. Two ends of the wire 70 penetrate the main body 10 respectively. More specifically, the reel 20 comprises a gear plate 21, a spool 22 and a disc 23. The spool 22 is formed with a penetrating hole 221. The wire 70 is a shoelace, especially made of, but not limited to, steel wire and for fastening an athletic shoe (FIG. 7 shows that the athletic shoe is a ski boot and the shoelace is used for fastening the ski boot). The wire 70 penetrates through the penetrating hole 221 of the spool 22 and winds on the spool 22. Two ends of the wire 70 penetrate through two through holes 111 of the base 11 respectively. The spool 22 has a rod. The disc 23 has an aperture. The rod of the spool 22 inserts to the aperture of the disc 23 so that the spool 22 and the disc 23 are turned simultaneously.

The first elastic member 30 is received in the receiving space 112. The first elastic member comprises two ends. One end of the first elastic member 30 is fixed on the base 11, and the other end of the first elastic member 30 is fixed on the disc 23 of the reel 20. Preferably, the first elastic member 30 is a volute spiral spring.

The rotating member comprises a base body 41, a clutch member 42 and a plurality of operation members 43. The base body 41 comprises a rotatable seat 411 and a positioning seat 412. The rotatable seat 411 includes a first surface and a second surface. The rotatable seat 411 is formed with a via hole. The first surface of the rotatable seat 411 has a ratchet portion 411*a*. The pawl portion 122 engages with the ratchet portion 411*a*, whereby, the rotatable seat 411 rotates unidirectionally with respect to the main body 10. The second surface of the rotatable seat 411 has a plurality of fixing portion 411*b*. More clearly, a periphery of the second surface of the rotatable seat 411 has a flange. The flange has a plurality of concave grooves 411*c*. The second surface of the rotatable seat 411 has a plurality of protrusions 411*d*. Each protrusion 411*d* corresponds to one of the concave grooves 411*c* and both of them define one of said fixing portions 411*b*. The positioning seat 412 is disposed in the rotatable seat 411. In this embodiment, the positioning seat comprises a plurality of insertion portions 412*a*. One end of each insertion portion 412*a* inserts to one of the fixing portion 411*b*. More definitely, each insertion portion 412*a* inserts to one of the concave grooves 411*c* and abuts against one of the protrusions 411*d*. The clutch member 42 is disposed between the base body 41 and the operation member 43. The clutch member 42 includes a first surface and a second surface. The first surface of the clutch member 42 has a first connection portion 421, and the second surface of the clutch member 42 has a second engaging portion 422 and a plurality of wings 423. The second engaging portion 422 faces to the via hole of the rotatable seat 411 and has a plurality of second teeth. A positioning groove 423*a* defines between any two of the wings 423. Each positioning groove 423*a* corresponds to one of the protrusions 411*d*. Each operation member 43 is swingably disposed on one of the insertion portions 412*a* and swings between a first position and a second position with respect to the rotatable seat 411 of the base body 41. More specifically, each operation member 43 comprises a pivot portion 431 and a pull portion 432. Each pivot portion 431 comprises a first end and a second end. Each pull portion 432 is disposed at the first end of one of the pivot portions 431. Each pivot portion is formed with a receiving groove 431*a* radially. Each receiving groove 431*a* penetrates through the second end of one of the pivot portions 431. One end of each insertion portion 412*a* away from each fixing portion 411*b* is received in one of the receiving grooves 431*a*. Each pivot portion 431 is formed with a pivot hole 431*b* in communication with one of the receiving grooves 431*a*. The extension direction of each pivot hole 431*b* is perpendicular with respect to the extension direction of the corresponding receiving groove 431*a*. Each insertion portion 412*a* has a pivot shaft 412*b*. Each pivot shaft 412*b* is rotatably received in one of the pivot holes 431*b*. Preferably, each pivot portion 431 is fan-shaped. Each pull portion 432 extends from the first end of one of the pivot portion 431 towards the main body 10.

The second elastic member 50 is disposed between the main body 10 and the clutch member 42. More clearly, center of the first engaging portion 121 has a through hole. The through hole of the first engaging portion 121 includes a large diameter section 123*a* and a small diameter section 123*b*. The second elastic member 50 is received in the large diameter section 123*a*. One end of the second elastic member 50 abuts to a step portion between the large and small diameter sections 123*a* and 123*b*. The other end of the second elastic member 50 penetrates through the via hole of the rotatable seat 411 and abuts to the second surface of the clutch member 42. Preferably, the second elastic member 50 is a metal coil spring.

The spindle 60 penetrates the rotating member and the second elastic member 50. The spindle 60 comprises a first end and a second end. The first end of the spindle 60 has a second connection portion 61. The shape of the first connection portion 421 corresponds to the shape of the second connection portion 61. Preferably, the first connection portion 421 has a plurality of first wedges, and the second connection portion 61 has a plurality of second wedges too. The first and second wedges correspond to each other. The spindle 60 has a gear wheel 62. Preferably, an outer surface of the second end of the spindle 60 is formed with screw threads, and the gear wheel 62 threads at the second end of the spindle 60. The gear plate 21 engages with the gear wheel 62.

Figure 4:
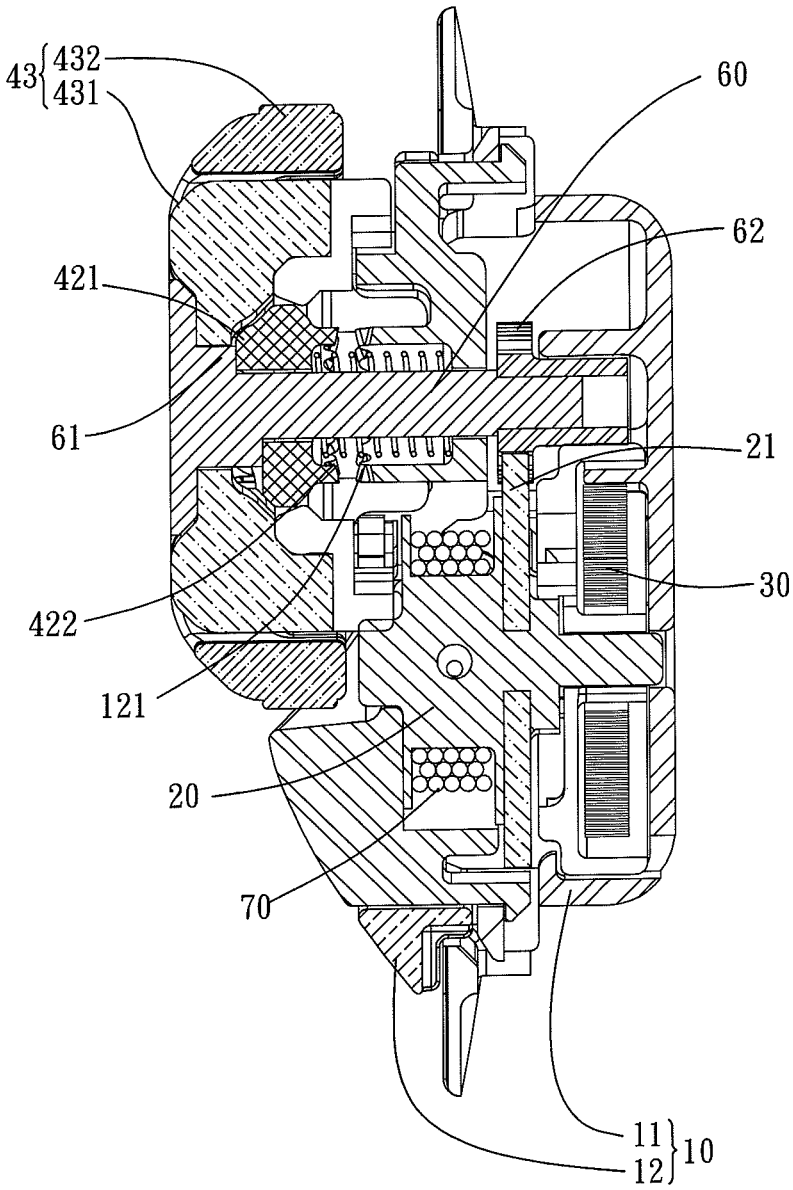
FIG. 4 is an A-A cross-sectional view of FIG. 1.

In use, please refer to FIG. 1, FIG. 4 and FIG. 7. The main body 10 is fixed on an athletic shoe. When the operation members 43 are located in the first position, the first connection portion 421 of the clutch member engages with the first connection portion 61 of the first end of the spindle 60, and the second engaging portion 422 is away from the first engaging portion 121. The whole rotating member is able to be turned by one hand directly. The rotating member drives the spindle 60 to rotate. The gear wheel 62 of the spindle 60 drives the gear plate 21 of the reel 20 to rotate. The whole reel 20 further rotates along a first direction, and the first elastic member is rolled up tightly. If a user turns the rotating member by one hand continuously, the wire 70 (shoelace) would continuously wind on the spool 22 till the tension of the wire 70 (shoelace) is adjusted well. The remaining wire 70 (shoelace) can wind on the spool 22.

Figure 5:
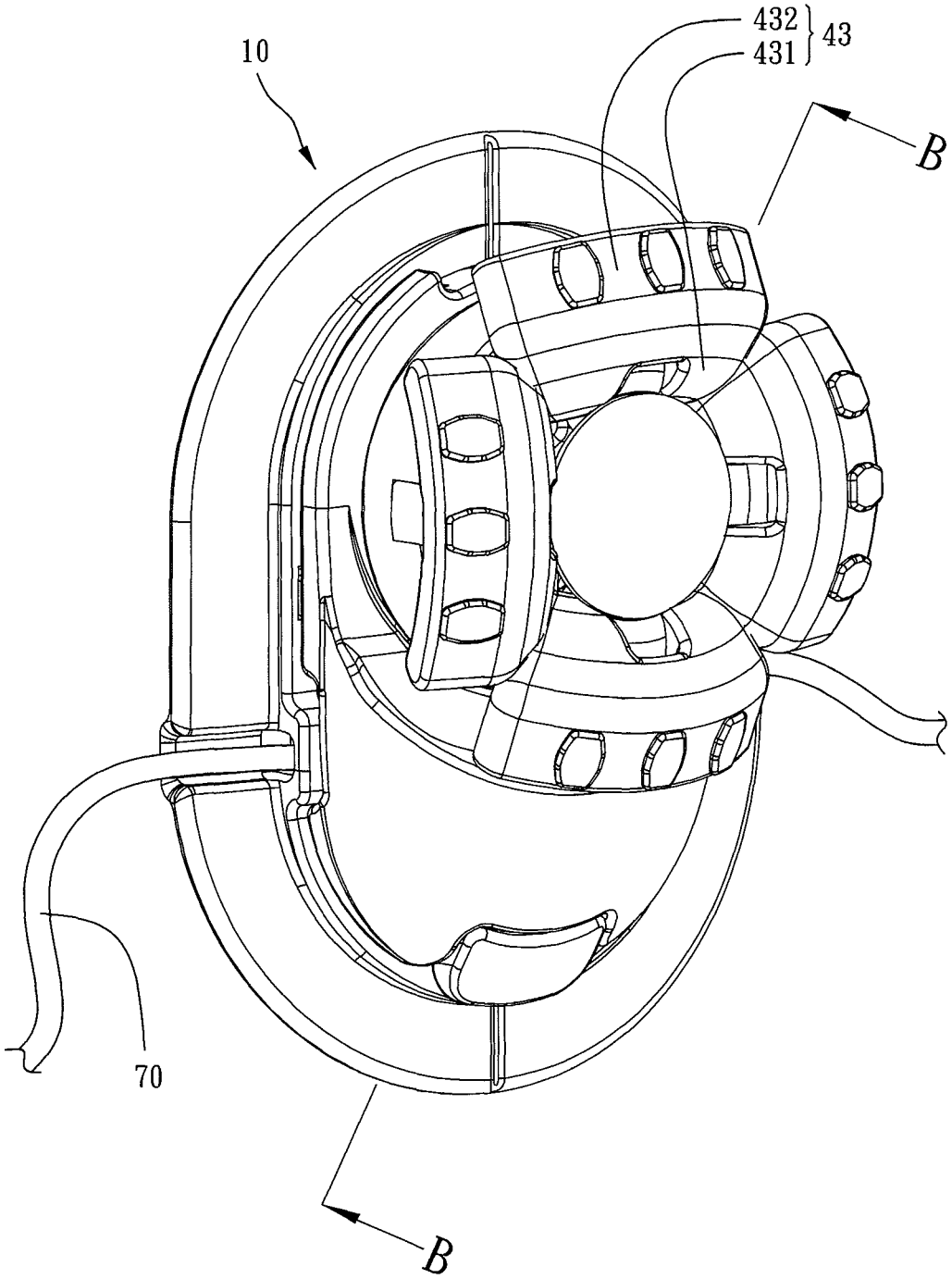
FIG. 5 is a schematic drawing showing how to release a shoelace by the present invention.
Figure 6:
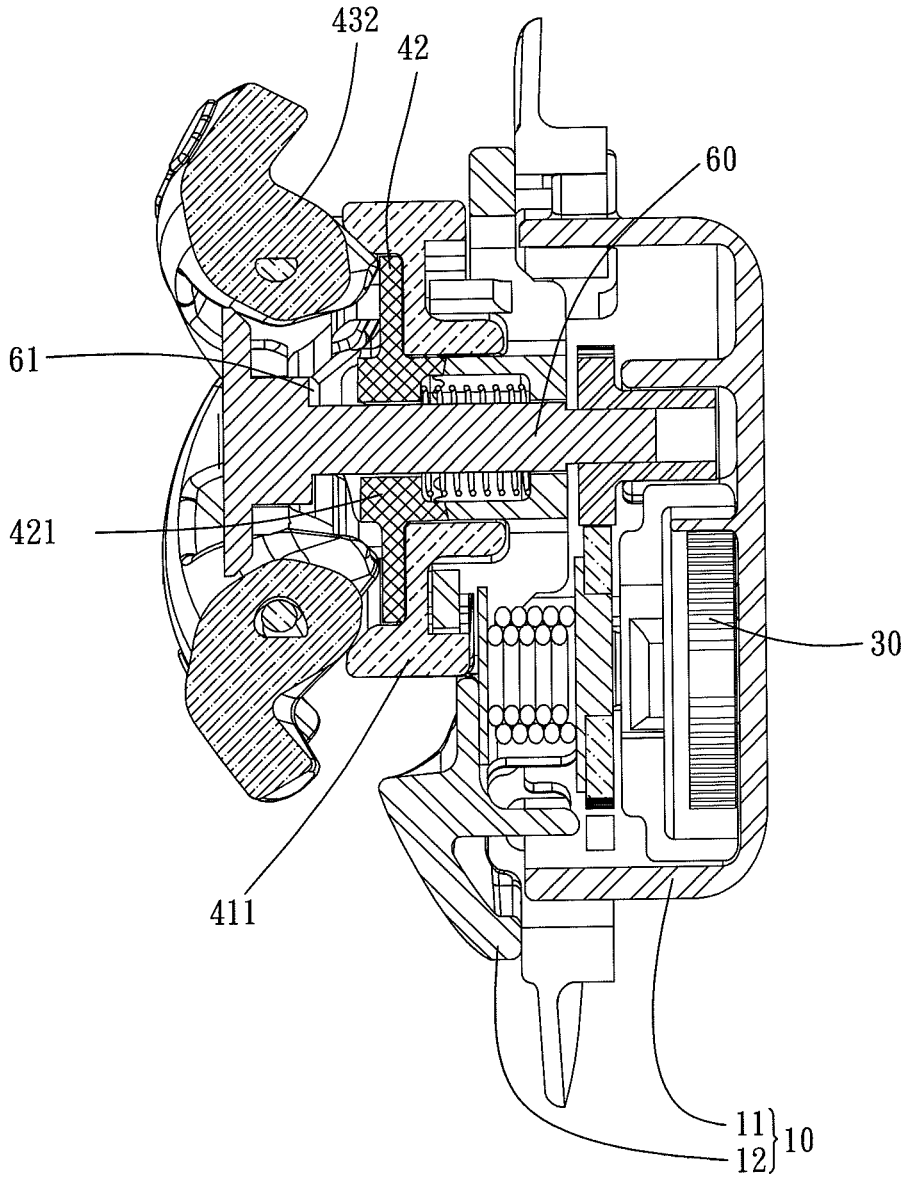
FIG. 6 is a B-B cross-sectional view of FIG. 5.

Please refer to FIG. 5 and FIG. 6. When the user would like to release the wire 70 (shoelace) by the shoelace fastener, the operation members 43 swing to the second position. The second ends of the pivot portions 431 push the first surface of the clutch member 42 so that the first connection portion 421 of the clutch member 42 is away from the second connection portion 61 of the first end of the spindle 60. The second engaging portion 422 of the clutch member 42 engages with the first engaging portion 121. The second elastic member 50 is compressed by the clutch member 42. At the present time, the clutch member 42 engages with the main body 10. Each protrusion 411*d* of the rotatable seat 411 is located in one of the positioning grooves 423*a* which defines between any two of wings 423 of the clutch member 42, in other words, the rotatable seat 411 is restricted by the clutch member 42. However, the spindle 60 is no more restricted by the rotating member. Whereby, the first elastic member 30 can release its elasticity to push the reel 20 to rotate along a second direction which is the opposite of the first direction. The reel 20 further drives the spindle 60 to rotate along the second direction. The rotating member does not rotate at all. At the moment, the user can hold two ends of the wire 70 by two hands and pull out the wire 70 from the shoelace fastener so that the wire 70 is released. In briefly, it is easy to control the tension of the wire 70 by two hands as the shoelace fastener releases the wire 70. When the operation members 20 swing back to the first position, the elasticity of the second elastic member 50 would push the clutch member 42 to move towards the first end of the spindle 30 till the first connection portion 421 engages with the second connection portion 61.

The operation members 43 swing with respect to the base body 41 and are pushed by the second elastic member 50 so that the clutch member 42 is away from or engages with the first end of the spindle 60. As a result, the tension of the wire 70 is easy to be controlled. The operation means is quite simple.

Moreover, the pawl portion 122 is able to engage the ratchet portion 411*a*, therefore, the rotating member can only rotate around the spindle 60 unidirectionally. As the clutch member 42 engages with the first end of the spindle 60, the reel 20 is restricted by the rotating member indirect, therefore, the reel 20 can also only rotate unidirectionally and does not turn in reverse. Thereby, the shoelace fastener prevents the reel 20 turning in reverse and further prevents the wire 70 (shoelace) releasing as the user is running.

Furthermore, while the operation members 43 are located in the second position, the operation members 43 are raised up with respect to the rotatable seat 411. At the moment, the shoelace fastener looks like an animal spreading its wings. Thereby, the user is aware of the wire 70 (shoelace) being released and is reminded that the reel 20 is not adjusted to rotate unidirectionally yet. After the reel 20 is adjusted to rotate unidirectionally, the shoelace fastener can prevent the wire 70 (shoelace) releasing as the user is running.

Besides, as the wire 70 is fastened too tight, the user can pull the operation members to the second position. The reel 20 will rotate along the second direction immediately, thereby, the wire 70 will recover to the best tension spontaneously.

In addition, the structure of the shoelace fastener of the present invention is so simple that it is easy to install and the manufacturing cost of the shoelace fastener is reduced.

What is claimed is:

1. A shoelace fastener, comprising:

a main body;

a reel, rotatably disposed in the main body, the reel being used for a wire winding thereon, two ends of the wire penetrating the main body respectively;

a first elastic member, comprising two ends, one end of the first elastic member fixed on the main body, and an other end of the first elastic member fixed on the reel;

a rotating member, comprising a base body, a clutch member and an operation member, one of the base body and the main body having a pawl portion, and an other one of the base body and the main body having a ratchet portion, the pawl portion engaging with the ratchet portion, the clutch member disposed between the base body and the operation member, the operation member moving between a first position and a second position with respect to the base body;

a spindle, penetrating the rotating member, the spindle comprising a first end and a second end;

wherein when the operation member is located in the first position, the clutch member engages with the first end of the spindle, the rotating member drives the spindle to rotate and the spindle drives the reel to rotate along a first direction and the first elastic member is rolled up tightly, when the operation member is located in the second position, the clutch member is away from the first end of the spindle, an elasticity of the first elastic member drives the reel to rotate along a second direction which is an opposite of the first direction, the reel drives the spindle to rotate along the second direction.

2. The shoelace fastener of claim 1, wherein the base body comprises a rotatable seat and a positioning seat, the positioning seat is disposed in the rotatable seat, the operation member is swingably disposed on the positioning seat and swings between the first and second positions with respect to the rotatable seat, when the operation member is located in the second position, one end of the operation member pushes the clutch member away from the first end of the spindle.

3. The shoelace fastener of claim 2, wherein the rotatable seat has a fixing portion, the positioning seat comprises a insertion portion, the insertion portion inserts to the fixing portion, the operation portion is swingably disposed on the insertion portion.

4. The shoelace fastener of claim 3, wherein the operation member comprises a pivot portion and a pull portion, the pivot portion comprises a first end and a second end, the pull portion is disposed at the first end of the pivot portion, the pivot portion is formed with a receiving groove radially, the receiving groove penetrates through the second end of the pivot portion, one end of the insertion portion away from the fixing portion is received in the receiving groove, one of the pivot portion and the insertion portion is formed with a pivot hole, and an other one of the pivot portion and the insertion portion has a pivot shaft, the pivot shaft is rotatably received in the pivot hole.

5. The shoelace fastener of claim 4, wherein the pivot portion is fan-shaped.

6. The shoelace fastener of claim 4, wherein the pull portion extends from the first end of the pivot portion towards the main body.

7. The shoelace fastener of claim 1, wherein the clutch member has a first connection portion, the first end of the spindle has a second connection portion, a shape of the first connection portion corresponds to a shape of the second connection portion.

8. The shoelace fastener of claim 7, wherein the main body comprises a first engaging portion, the clutch member comprises a first surface and a second surface, the first surface of the clutch member has the first connection portion, the second surface of the clutch member has a second engaging portion, when the operation member is located in the first position, the second engaging portion is away from the first engaging portion, when the operation member is located in the second position, the second engaging portion engages with the first engaging portion.

9. The shoelace fastener of claim 1, comprising a second elastic member, the second elastic member disposed between the main body and the clutch member.

10. The shoelace fastener of claim 1, wherein the reel comprises a gear plate, the spindle has a gear wheel, the gear plate engages with the gear wheel.

* * * * *